US008240946B2

(12) United States Patent
Applefield

(10) Patent No.: US 8,240,946 B2
(45) Date of Patent: Aug. 14, 2012

(54) WATER DRAINAGE SYSTEM

(76) Inventor: Sheldon Applefield, Novi, MI (US)

( * ) Notice: Subject to any disclaimer, the term of this patent is extended or adjusted under 35 U.S.C. 154(b) by 0 days.

(21) Appl. No.: 12/902,262

(22) Filed: Oct. 12, 2010

(65) Prior Publication Data

US 2011/0097146 A1 Apr. 28, 2011

Related U.S. Application Data

(60) Provisional application No. 61/255,298, filed on Oct. 27, 2009.

(51) Int. Cl.
*E01F 5/00* (2006.01)

(52) U.S. Cl. ..... 404/4; 404/2; 404/3; 405/36; 405/118

(58) Field of Classification Search ..... 404/2, 4, 404/7

See application file for complete search history.

(56) References Cited

U.S. PATENT DOCUMENTS 4,815,888 A * 3/1989 Stegmeier ..... 404/4
5,256,000 A * 10/1993 Beamer ..... 405/119
6,132,137 A * 10/2000 Gunter ..... 405/36
6,792,723 B2 * 9/2004 Stegmeier et al. ..... 52/169.5
7,048,466 B2 * 5/2006 Benesteau et al. ..... 404/4
7,866,911 B2 * 1/2011 Saadi et al. ..... 404/4
7,909,531 B2 * 3/2011 Shaw et al. ..... 404/2
7,959,372 B2 * 6/2011 Shanley ..... 404/2
2002/0057945 A1 * 5/2002 Dahowski et al. ..... 405/118
2004/0062602 A1 * 4/2004 Dahowski et al. ..... 404/2
2004/0115001 A1 * 6/2004 Suazo et al. ..... 405/36
2005/0042030 A1 * 2/2005 Fu ..... 405/36
2005/0100401 A1 * 5/2005 Urriola et al. ..... 404/2
2006/0222458 A1 * 10/2006 Grimes ..... 404/2
2006/0239773 A1 * 10/2006 Meyers ..... 404/2

* cited by examiner

*Primary Examiner* — Raymond W Addie
(74) *Attorney, Agent, or Firm* — Gifford, Krass, Sprinkle, Anderson & Citkowski, P.C.

(57) ABSTRACT

A water drainage system having an elongated housing constructed from a plurality of identical subhousings which are aligned end to end. The housing is constructed of a flexible material and includes an elongated longitudinally extending interior chamber and at least one inlet open to a top of the housing and the chamber. A drainage pipe is attached to the housing and has one end open to the chamber and its other end at a location which dissipates water collected within the housing chamber.

7 Claims, 3 Drawing Sheets

WATER DRAINAGE SYSTEM

CROSS-REFERENCE TO RELATED APPLICATIONS

This application claims priority of U.S. Provisional Patent Application Ser. No. 61/255,298 filed Oct. 27, 2009, which is incorporated herein by reference.

BACKGROUND OF THE INVENTION

I. Field of the Invention

The present invention relates generally to water drainage systems and, more particularly, to such a system particularly suitable for paved roads.

II. Description of Related Art

Public as well as private roads are subjected to a great deal of wear and tear and other destructive forces from nature. This is particularly true for concrete roads in the northern portions of the United States as well as other colder regions. Such concrete roads and cold regions are all subjected to four seasons, namely fall, winter, spring, and summer. As such, these roads must be able to withstand wide temperature variations.

Winter and spring are perhaps the most destructive for such concrete and other paved roads. In particular, water from rainfall or melting snow seeps through the expansion joints formed between adjacent concrete pads which form the road. This water freezes in the winter and expands. Such expansion oftentimes results in cracks in the concrete which, in turn, creates additional openings in the concrete for water to seep through the concrete and collect underneath it. Pools of water underneath the concrete may even cause the concrete to collapse thus forming potholes in the road. Such potholes not only result in a dangerous driving condition for the road, but require constant and expensive repair by road workers.

A primary reason that the concrete roads in colder regions crack and form potholes is due to improper dissipation of surface water. Indeed, many roads have no means, whatsoever, to dissipate the water from rain and melting snow before it can seep underneath and between the concrete slabs which form the road.

SUMMARY OF THE PRESENT INVENTION

The present invention provides a water drainage system particularly suited for paved roads and especially paved concrete roads which overcomes the above-mentioned disadvantages of the previously known paved roads.

In brief, the water drainage system of the present invention comprises an elongated housing constructed of a flexible material, such as rubber. Preferably, the rubber is made from crumbled or shredded automotive tires which are then fused together by heat or an adhesive to form the housing. This elongated housing, furthermore, is positioned alongside of the paved roads where water might otherwise collect.

An elongated chamber is formed within the housing and extends longitudinally along the length of the housing. An inlet is formed in the top of the housing which is open to the chamber so that water on top of the housing flows through the inlet and into the housing chamber.

A drainage pipe is also attached to the housing and has one end open to the housing chamber. The other end of the drainage pipe is open to a water collection system, such as a sewer system or ground area beneath the frost line that is suitable to dissipate water. Consequently, upon rainfall or melting of snow, the resulting water flows through the inlet and into the housing chamber and out through the drainage pipe. In doing so, the drainage system prevents the accumulation of water pools beneath the concrete which might otherwise freeze, expand, and crack the concrete.

In the preferred embodiment of the invention, the housing is constructed from a plurality of substantially identical elongated subhousings that are aligned end to end with respect to each other. An interlocking offset portion is formed at each end of the housing which not only properly aligns the subhousings to the adjacent subhousings, but also ensures that the subhousings are attached and locked into position relative to their adjacent subhousings.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
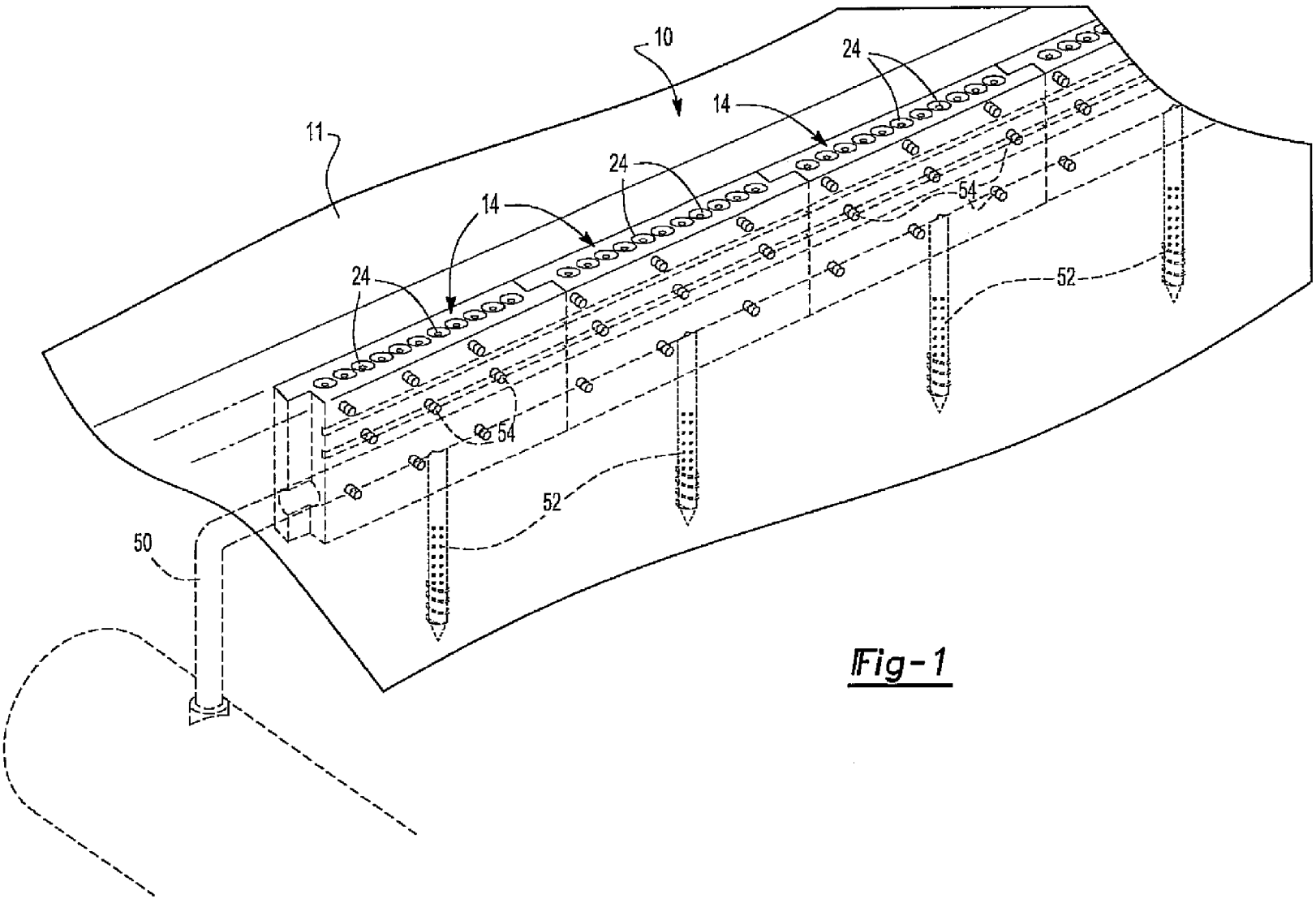
FIG. 1 is a diagrammatic view illustrating a preferred embodiment of the present invention.

With reference first to FIG. 1, a preferred embodiment of a water drainage system 10 of the present invention is shown. The water drainage system 10 includes an elongated housing 12 which extends along a portion of a road 11 at areas likely to otherwise collect pooled water during rainfalls or from melting snow. For example, the housing 12 may be buried beneath the surface of the road 11 along the sides or even in the center portion of the road.

Figure 2:
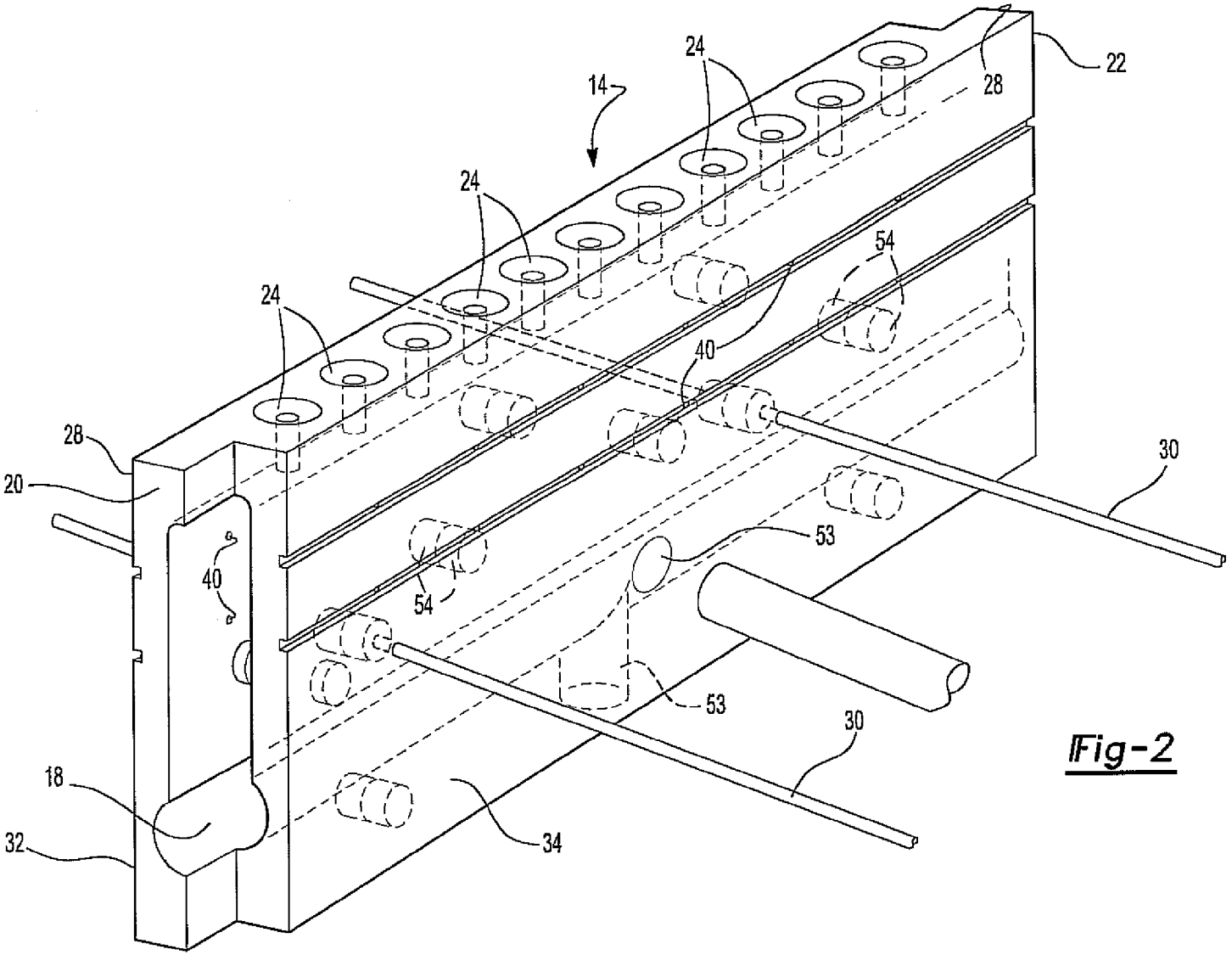
FIG. 2 is an elevational view illustrating one subhousing of the drainage system.
Figure 3:
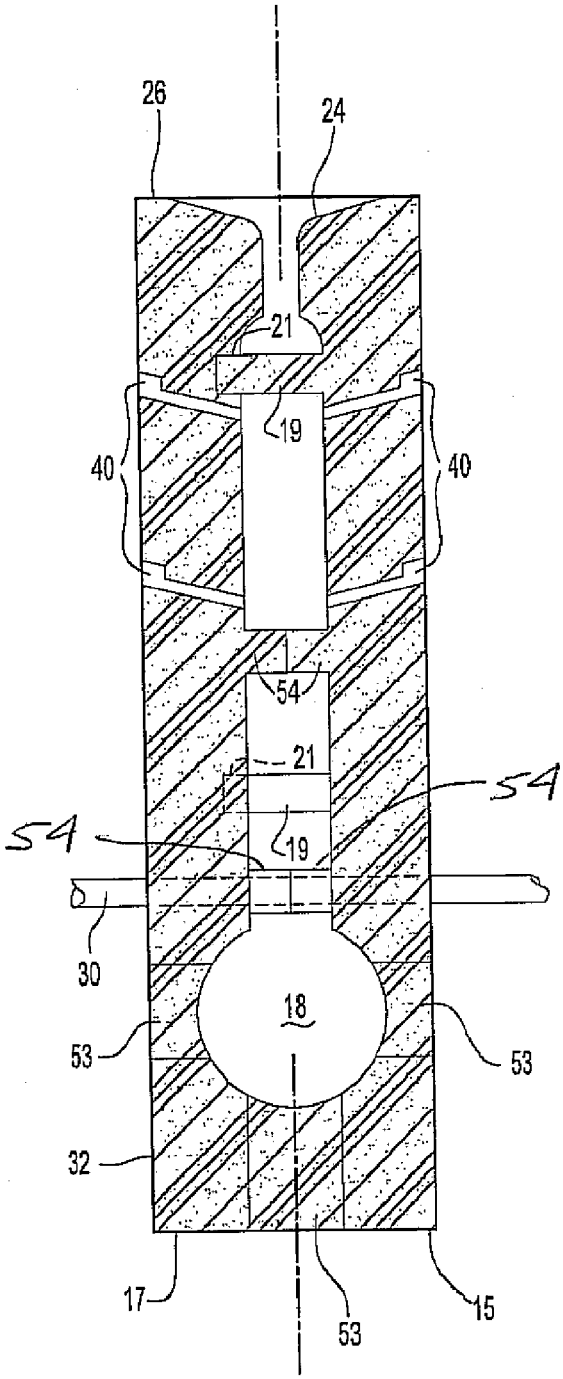
FIG. 3 is a sectional view taken substantially along line 3-3 in FIG. 2.

With reference now especially to FIGS. 1-3, the housing 12 is preferably constructed from a plurality of substantially identical elongated subhousings 14 that are aligned end to end relative to each other to form the overall housing 12. Each subhousing 14 includes an interior water collection chamber 18 that extends longitudinally along the housing 14 and is open at each end 20 and 22 of the subhousing 14.

Each subhousing 14 includes two halves 15 and 17 (see FIG. 3) which adhere to each other. Alignment pegs 19 on the half 15 register with alignment recesses 21 on the half 17 to align the halves 15 and 17 together.

At least one, and preferably a plurality of longitudinally spaced inlets 24 are formed along the top 26 of the subhousing 14. These inlets 24 are preferably slightly recessed, as best shown in FIG. 3, so that water collected along the top 26 of the subhousing 14 flows through the inlet 24 and into the housing chamber 18.

A key or offset portion 28 (FIG. 2) is formed at each end 20 and 22 of the subhousing 14. These offset portions 28 thus not only ensure proper alignment of each subhousing 14 relative to its adjacent subhousings 14, but also lock each subhousing 14 to its adjacent subhousings 14 against lateral movement. This ensures that the housing chamber 18 and all of the aligned subhousings 14 fluidly communicate with each other.

In order to further lock the housing 10 against movement relative to the ground, one or more support bars 30 extend laterally through the subhousing 14 and laterally outwardly from opposite sides 32 and 34 of the subhousing 14. These support bars 30 are positioned at spaced apart locations along the subhousing 14.

As best shown in FIG. 3, a drainage opening 40 is preferably provided in at least one, and preferably both sides 32 and 34 of the subhousing 14. These drainage openings 40 are spaced downwardly from the top 26 of the subhousing 14 and slope downwardly from an outside surface of the sides 32 and 34 of the housing 14 and to the housing chamber 18. Consequently, any water seepage which occurs along the outer surface of the sides 32 and 34 of the subhousing 14 will flow through the drainage openings 40 and into the housing chamber 18 for subsequent disposal.

With reference now to FIGS. 1 and 3, the collected water within the housing chamber 18 may be disposed of in several different fashions. For example, a drainage pipe 50 may be fluidly collected to the housing chamber 18 at one end and have its other end open to a sewer, drainage ditch, or other drainage reservoir. Similarly, a drainage pipe 52 may be open at one end to the housing chamber 18 and open at its other end to a position below the frost line of the ground. This drainage pipe 52' would require that the soil conditions be such that the collected water would be properly dissipated. Appropriate knockouts 53 (FIG. 3) are removable from the subhousing 14 to accommodate the pipes 52.

With reference again to FIG. 3, the entire subhousing 14 is preferably of a one piece construction and made of a flexible material to allow for expansion and contraction of the road concrete without damage to the subhousing 14. Preferably, the subhousing 14 is constructed of crumbled or shredded automotive tires which are bound together by a resin, heat, or any conventional fashion to form the subhousing 14. Preferably, the subhousing 14 is of a one piece molded construction.

Figure 4:
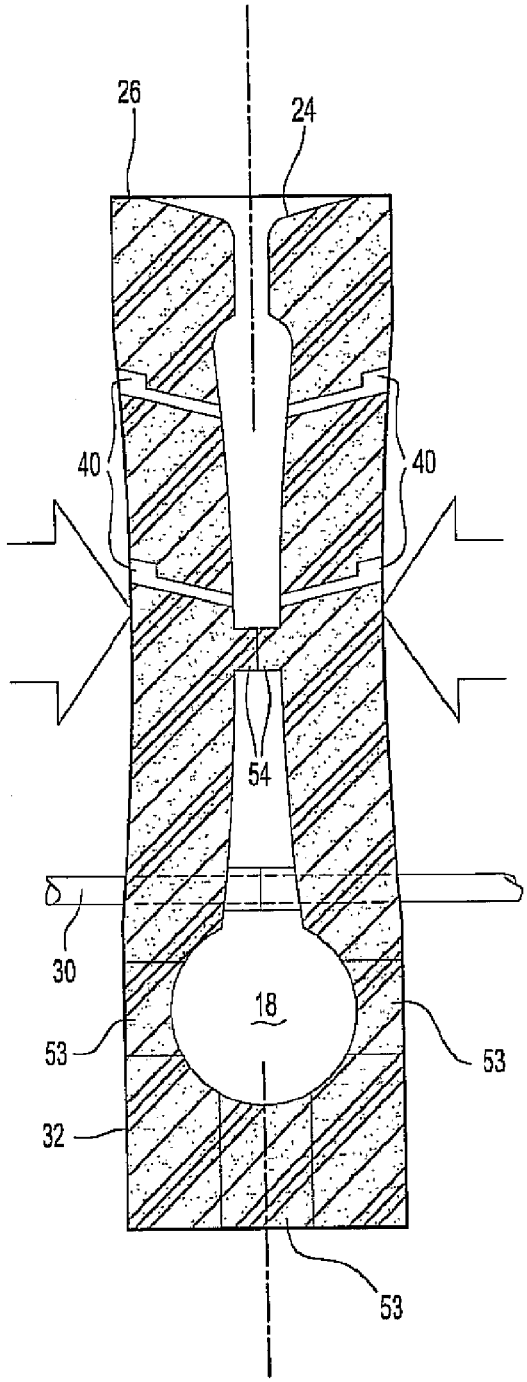
FIG. 4 is a view similar to FIG. 3, but illustrating the subhousing during a time of concrete expansion.

At least one, and preferably several spaced apart standoffs 54 extend across the housing and are integrally formed with the subhousing 14 and facing standoffs adhere to each other. These stand offs 54 prevent the housing chamber 18 from collapsing as the housing 14 moves from the position shown in FIG. 3 to the position shown in FIG. 4 during expansion of the concrete. These standoffs 54 thus allow lateral compression of the housing 14 caused by concrete expansion while preventing the complete collapse of the subhousing 14 which would otherwise interfere with the water flow from the inlet 24 and to the housing chamber 18.

The support bars 30 also extend through the stand offs 54 which seal the support bars 30 from water in the housing.

From the foregoing, it can be seen that the present invention provides a simple, inexpensive, and yet highly effective water drainage system that is particularly suited for water drainage along a paved highway and especially a paved concrete highway. Having described my invention, however, many modifications thereto will become apparent to those skilled in the art to which it pertains without deviation from the spirit of the invention as defined by the scope of the appended claims.

I claim:

1. A water drainage system comprising:

an elongated housing constructed of a flexible material, said housing having an elongated longitudinally extending interior chamber and at least one inlet open to both a top of said housing and said chamber, a drainage pipe attached to said housing and having one end open to said chamber, wherein said housing comprises a plurality of aligned and substantially identical elongated subhousings, each subhousing open at each end of said subhousing, each subhousing being of a one piece construction, wherein each subhousing includes a key at each end which meshes with the keys at the ends of the adjacent subhousings to thereby align said subhousings together, said key protruding longitudinally outwardly from each end of each subhousing and having a width of substantially one half the width of said subhousing and a height the same as the height of said subhousing, and wherein said key is a one piece construction with said subhousing, wherein the keyed ends of said subhousings are adapted to align said drainage pipewith said interior chamber.

2. The water drainage system as defined in claim 1 wherein said flexible material comprises crumbled or shredded automotive tires.

3. The water drainage system as defined in claim 1 wherein said housing includes at least one standoff extending at least partially across said chamber, said standoff limiting compression of said housing from one side to the other.

4. The water drainage system as defined in claim 1 and comprising at least one drainage opening extending from one side of said housing at a position spaced downwardly from said top of said housing and said chamber.

5. The water drainage system as defined in claim 4 and comprising at least two drainage openings, one drainage opening extending through each side of said housing.

6. The water drainage system as defined in claim 4 wherein said drainage opening slopes downwardly from an outside of said housing and to said chamber.

7. The water drainage system as defined in claim 1 and comprising at least one reinforcing rod attached to and extending laterally outwardly from said housing.

* * * * *